United States Patent [19]

Atkins, Sr.

[11] Patent Number: 4,480,776

[45] Date of Patent: Nov. 6, 1984

[54] THUMB BREAK HOLSTER HAVING MEANS FOR PREVENTING FORCIBLE WITHDRAWAL OF A HAND GUN THEREFROM

[75] Inventor: John H. Atkins, Sr., Cincinnati, Ohio

[73] Assignee: A & B Industries, Inc., Cincinnati, Ohio

[21] Appl. No.: 530,543

[22] Filed: Sep. 9, 1983

[51] Int. Cl.[3] ..... F41C 33/02

[52] U.S. Cl. ..... 224/243; 224/238; 224/911

[58] Field of Search ..... 224/243, 238, 206, 198, 224/193, 911

[56] References Cited

U.S. PATENT DOCUMENTS

| | | | |
|---|---|---|---|
| 202,733 | 4/1978 | LePage . | |
| 787,852 | 4/1905 | Mills . | |
| 894,569 | 7/1908 | Batchelder . | |
| 1,062,238 | 5/1913 | Jennings . | |
| 1,102,195 | 6/1914 | Jennings . | |
| 1,110,993 | 9/1915 | Sisson . | |
| 2,297,008 | 9/1942 | McMillan | 224/2 |
| 2,917,213 | 12/1959 | Bucheimer et al. | 224/2 |
| 3,200,021 | 8/1965 | Clark | 156/93 |
| 3,865,289 | 2/1975 | Boren | 224/2 |
| 4,143,798 | 3/1979 | Perkins | 224/911 X |
| 4,190,183 | 2/1980 | Yates | 224/911 X |
| 4,270,680 | 6/1981 | Bianchi | 224/193 |
| 4,273,276 | 6/1981 | Perkins | 224/243 |
| 4,286,741 | 9/1981 | Rogers | 224/193 |
| 4,298,150 | 11/1981 | Seldeen | 224/911 X |
| 4,303,185 | 12/1981 | Shoemaker | 224/911 X |

*Primary Examiner*—Steven M. Pollard
*Attorney, Agent, or Firm*—Simon Groner

[57] ABSTRACT

A nylon fabric holster for hand guns having strap-like tabs secured together by hook and loop fasteners for holding the hand gun in the holster. The tabs may be separated by running the thumb between the hook and loop fasteners. However, the hammer spur associated with the hand gun is pressed against the inner surfaces of the tabs upon forcible withdrawal of the hand gun from the holster to prevent the tabs from separating. The tab construction thus prevents the hand gun from being forcibly removed from the holster when the tabs are secured together.

9 Claims, 4 Drawing Figures

THUMB BREAK HOLSTER HAVING MEANS FOR PREVENTING FORCIBLE WITHDRAWAL OF A HAND GUN THEREFROM

SUMMARY OF THE INVENTION

The present invention is directed to a hand gun holster, and more particularly to a holster having a closable flap by which the hand gun may be secured in place against forcible withdrawal, but which can be easily opened by the wearer for quickly removing the hand gun from the holster.

It is an unfortunate statistic that a significant percentage of law enforcement officers who are killed in the line of duty are killed with their own weapons. Many of these tragedies could be avoided if the hand gun could be securely held in the holster against forcible removal.

Unfortunately, even under the most harmless appearing situations, the peace officer must at all times have his weapon ready at hand should the need arise. Consequently, any type of provision which prevents forcible removal of the hand gun from the holster but is not readily operable by the officer to immediately release the hand gun for use would actually serve to further endanger the officer's safety.

Various methods have been suggested for quickly releasing the hand gun restraint so that the gun may be quickly drawn from the holster. One type of quick release means in common usage is the thumb release holster. In this type of construction, the restraint, often in the form of a snap-down strap, can be quickly released by merely sliding the thumb between the separable portions of the strap. With a little experience, the thumb break strap may be opened in the same motion used to draw the hand gun.

Unfortunately, in many instances such release mechanisms also make it easier for the hand gun to be forcibly pulled from the holster even while the restraint strap is in place. Consequently, a need has been shown for a holster having a thumb break restraint which can be easily operated by the officer, but which is highly resistant to forcible removal of the firearm from the holster.

The present invention fulfills that need. In a preferred embodiment, the thumb break holster of the present invention includes a first padded panel having a peripheral margin, the upper end of the panel being wider than the lower portion of the panel. The upper forward portion of the panel forms an upwardly extending tab including hook and loop fasteners disposed on the inner surface of the tab.

A second panel of substantially the same shape and size as the first panel is joined to the first panel along their lower and rear margins. The second panel includes an upwardly extending second tab overlying the first tab. The upper edge of the second tab terminates in a relatively stiff latch flap having a length less than the length of the second tab. The flap is joined to the second tab such that it folds inwardly and downwardly against the inner surface of the second tab. The latch flap is positioned so that the hammer spur associated with the hand gun fits between the flap and the second tab when the hand gun is inserted in the holster. Hook and loop fasteners are also disposed on the inwardly facing surface of the flap so that when the flap is pressed against the inner surface of the first tab, the first and second tabs are held securely together.

A triangular shaped bolster portion is joined along its front and rear edges to the front edges, respectively, of the panels so that the forward portion of the panels are spaced apart. The panels and bolster form a cavity therewithin for receiving a hand gun inserted into the holster through an opening defined by the upper edges of the panels and bolster.

A belt loop is provided on the outer surface of the first panel for securing the holster to the user's belt.

In use, with the tabs fastened to each other by the hook and loop fasteners, the weapon is securely held in place. If an attempt is made to forceably withdraw the weapon from the holster by grasping the handle, the hammer spur presses against the inner surface of the latch flap in such a way that the joined tabs do not separate. However, the tabs may be easily separated by the wearer to remove the hand gun by running the thumb between the joined hook and loop fasteners. With a minimum of practice, this latter operation can be accomplished in the same motion used to draw the hand gun.

The entire holster may be fabricated from nylon or similar material to create a light weight, waterproof and durable holster. The entire holster may also be fabricated from the more traditional materials of construction, namely leather and leather-like materials.

Further features of the invention will become apparent from the detailed description which follows.

DETAILED DESCRIPTION

Figure 1:
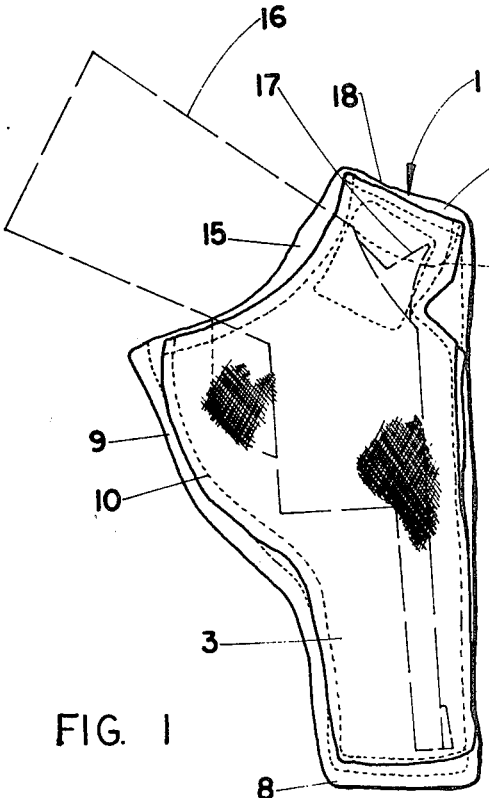
FIG. 1 is a front elevational view of the holster of the present invention with a hand gun represented diagrammatically inserted in the holster.
Figure 2:
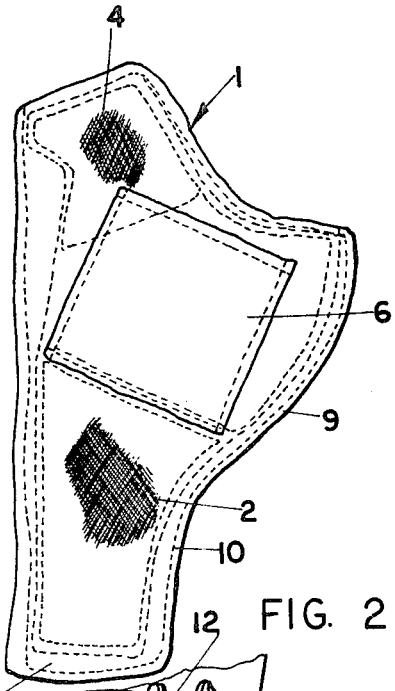
FIG. 2 is a rear elevation view of the holster of the present invention.
Figure 3:
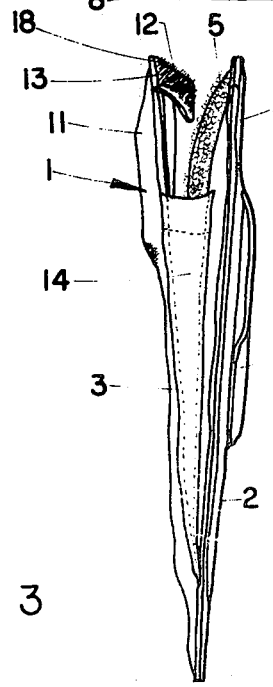
FIG. 3 is a side elevation view of the holster of the present invention with the latch flap separated from the first tab.

The thumb break holster of the present invention is illustrated generally at 1 in FIG. 1–FIG. 4. Holster 1 includes a body formed by a first inner panel 2 and a second outer panel 3. Inner panel 2 is shaped so that the upper end of the panel is wider than the lower portion of the panel, as can best be seen in FIG. 2.

The upper forward portion of inner panel 2 terminates in an upwardly extending flexible tab 4. The inner surface of tab 4 is provided with hook and loop fasteners 5 such as Velcro (see FIG. 3).

A belt loop 6 is secured to the outer face of inner panel 2 so that holster 1 may be secured on the wearer's belt as is well known in the art. In addition, since inner panel 2 is worn against the wearer's body, the entire inner panel may be provided with a suitable interior padding or cushioning material 7 such as foam rubber or the like.

Outer panel 3 is of substantially the same shape and size as inner panel 2. In the preferred embodiment illustrated, only the tab portion 4 is provided with padding 7, although such padding may be included in the remainder of panel 2, provided if desired.

Outer panel 3 is joined to inner panel 2 along their lower margins 8 and rear margins 9 by means of stiching or the like as at 10. It will be observed that such stiching forms a relatively stiff seam for providing rigidity to the lower and rear margins of the holster.

The forward upper portion of outer panel 3 is provided with an upwardly extending flexible tab 11 which overlies but is separate from tab 4 associated with inner panel 2. The upper edge of tab 11 terminates in a relatively stiff latch flap 12. The length of latch flap 12 is less than the length of tab 11 as can best be seen in FIG. 3. In addition, latch flap 12 is joined along its upper edge to the upper edge of tab 11 such that the latch flap folds inwardly and downwardly against the inner surface of tab 11, again as can best be seen in FIG. 3 and FIG. 4.

The inner surface of latch flap 12 is provided with hook and loop fasteners 13 such as Velcro or the like in such a way that when latch flap 12 is pressed against tab 4, the mating hook and loop fasteners 5 and 13, respectively, will operate to hold latch flap 12 securely against tab 4.

To complete holster 1, a triangular-shaped bolster portion 14 is joined along its front and rear edges to the front edges, respectively, of inner panel 2 and outer panel 3. This construction serves to space apart the forward portions of the panels so that the panels 2 and 3, and bolster 14 form a cavity therewithin for receiving a hand gun. The upper portions of panels 2 and 3 are not attached together so as to form an opening 15 through which the hand gun, shown diagrammatically at 16 in FIG. 1 and FIG. 4, can be inserted into the holster.

Figure 4:
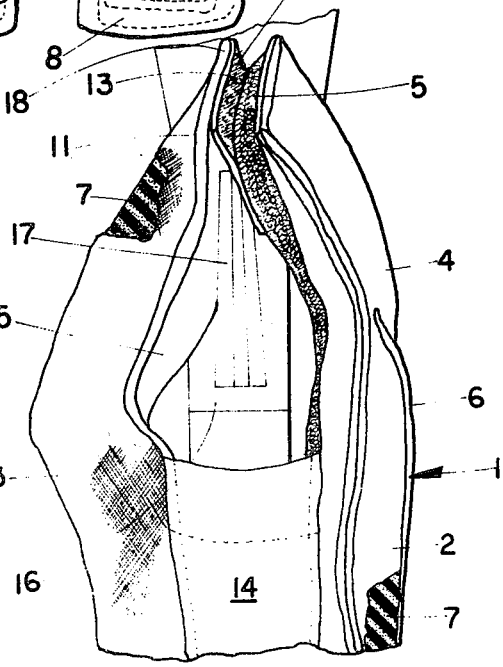
FIG. 4 is an enlarged fragmentary partially cut away side elevation view of the holster with a hand gun secured in place.

FIG. 4 illustrates the hand gun 16 in place within holster 1, and the upper securing tabs 4 and 11 attached together. It will be observed that the tabs may be easily separated to remove the hand gun by merely running the user's thumb between the hook and loop fasteners 13 on latch flap 12 and the hook and loop fasteners 5 on tab 4. In general, the user's thumb will be drawn from front to rear so as to separate the tabs, in the same motion used to draw the weapon. After the tabs are separated, the butt of the hand gun may be grasped and the hand gun withdrawn from within the holster.

It will also be observed, as best shown in FIG. 4, that the specific construction of FIG. 1 also prevents forcible and unintended withdrawal of the hand gun from the holster when tabs 4 and 11 are secured together. Specifically, it will be observed that the upper end or point of hammer spur 17 of hand gun 16 fits nicely within the pocket formed between the facing surfaces of latch flap 13 and tab 11. Consequently, if an attempt is made to withdraw the hand gun while tabs 4 and 11 are attached together as illustrated in FIG. 4, the upper end of the hammer spur will be forced upwardly against the lower edge of seam 18 joining the upper edges of latch flap 12 and tab 11. This operation serves to force the surface of latch flap 12 mounting hook and loop fasteners 13 more tightly against the hook and loop fasteners 5 of tab 4, thereby actually increasing the attachment between tabs 4 and 11. In other words, attempted forcible withdrawal of hand gun 16 with tabs 4 and 11 secured together actually operates to force the tabs more tightly together. Consequently, the tabs cannot be separated by attempted forcible withdrawal of the hand gun. The tabs, however, may be easily separated as described hereinabove by running the user's thumb between the cooperating hook and loop fasteners.

For purposes of an exemplary showing, holster 1 may be fabricated entirely from light weight durable nylon material. Such material is easily cut to form the component parts of the holster. The component parts may then be easily sewn together to complete the holster construction. As noted hereinabove, padding may be provided for the comfort of the wearer. In addition, the relatively slick surface of the nylon material facilitates the withdrawal of the hand gun from the holster. Furthermore, the entire holster is relatively light weight and water resistant, thereby serving to protect the hand gun.

It will be understood that various changes in the steps, details, materials and arrangements of parts, which have been herein described and illustrated in order to explain the nature of the invention, may be made by those skilled in the art within the principle and scope of the invention as expressed in the appended claims.

The embodiments of the invention in which an exclusive property or privilege is claimed are as follows:

1. A holster for holding a hand gun comprising:

a first panel having a peripheral margin, the upper end of said panel being wider than the lower portion of said panel, the upper forward portion of said panel forming an upwardly extending tab including fastening means disposed on the inner surface of said tab;

a second panel of substantially the same shape and size as said first panel, said panels being joined along their lower and rear margins, said second panel including an upwardly extending second tab overlying said first mentioned tab, the upper edge of said second tab terminating in a latch flap having a length less than the length of said second tab, said flap being joined to said second tab such that it folds inwardly and downwardly against the inner surface of said second tab, said flap being positioned so that the hammer spur associated with the hand gun fits between the flap on the second tab when the hand gun is inserted into the holster, and fastening means disposed on the inwardly facing surface of said latch flap such that when said flap is pressed against the inner surface of said first tab, said first and second tabs will be held together, whereby said tabs may be easily separated to remove the hand gun by running a thumb between said fastening means but the hand gun cannot be pulled from the holster while said tabs are held together.

2. The holster according to claim 1 wherein said fastening means comprise hook and loop fasteners, said tabs being separable when joined by running a thumb between cooperating hook and loop fasteners.

3. The holster according to claim 2 including a triangular shaped bolster portion joined along its front and rear edges to the front edges, respectively, of said panels such that the forward portions of said panels are spaced apart, said panels and bolster forming a cavity therewithin for receiving a hand gun inserted into the holster through an opening defined by the upper edges of said panels and bolster.

4. The holster according to claim 3 wherein a portion at least of said first panel is padded.

5. The holster according to claim 4 including means associated with said first panel for attaching said holster to a belt.

6. The holster according to claim 5 wherein said panels and holster comprise leather.

7. The holster according to claim 5 wherein said panels and holster comprise leather-like materials.

8. The holster according to claim 5 wherein said panels and bolster comprise a fabric material.

9. The holster according to claim 8 wherein said material comprises nylon.

* * * * *